US009510703B2

(12) United States Patent
Ferk

(10) Patent No.: US 9,510,703 B2
(45) Date of Patent: Dec. 6, 2016

(54) DEVICE FOR HANGING OF TEXTILES

(71) Applicant: Tüchler Bühnen- & Textiltechnik GmbH, Vienna (AT)

(72) Inventor: Reinhard Ferk, Vienna (AT)

(73) Assignee: Tüchler Bühnen- & Textiltechnik GmbH, Vienna (AT)

( * ) Notice: Subject to any disclaimer, the term of this patent is extended or adjusted under 35 U.S.C. 154(b) by 64 days.

(21) Appl. No.: 14/644,807

(22) Filed: Mar. 11, 2015

(65) Prior Publication Data

US 2015/0257570 A1 Sep. 17, 2015

(30) Foreign Application Priority Data

Mar. 11, 2014 (AT) ..... A50176/2014

(51) Int. Cl.
*A47H 13/01* (2006.01)
*A63J 1/02* (2006.01)

(52) U.S. Cl.
CPC ..... *A47H 13/01* (2013.01); *A63J 1/02* (2013.01); *Y10T 16/353* (2015.01)

(58) Field of Classification Search
CPC ..... A47H 13/01; A47H 2201/01; A63J 1/02; A63J 1/028; Y10T 16/353; Y10T 16/37; Y10T 16/372
See application file for complete search history.

(56) References Cited

U.S. PATENT DOCUMENTS 996,886 A * 7/1911 Schneider ..... A47H 13/04 16/87.2
1,213,569 A * 1/1917 Wordingham ..... A47G 25/30 16/87.2
6,382,297 B1 * 5/2002 Takizawa ..... A44B 18/0049 160/330
6,450,234 B2 * 9/2002 Welfonder ..... E06B 9/362 16/87.2
6,484,788 B1 * 11/2002 Jerrell ..... A47H 13/02 16/87.2
7,007,428 B2 * 3/2006 Santa Cruz ..... A63J 1/028 182/132
7,509,992 B2 * 3/2009 Fragoso ..... A63J 1/02 160/331

(Continued)

FOREIGN PATENT DOCUMENTS

DE 299 06 503 U1 9/1999

*Primary Examiner* — Jeffrey O Brien
(74) *Attorney, Agent, or Firm* — Seed IP Law Group LLP

(57) ABSTRACT

The invention concerns a device for the hanging of textiles, such as, for example, curtains, with a holding element, which can be fastened onto a fixed structure, a counterplate securely attached onto the holding element, a pressure plate fastened in a hinged manner onto the holding element, wherein the pressure plate with the counterplate forms a clip for purposes of securing the textiles, and with an electromagnet, which operates together with an armature plate so as to close the clip. A particularly low level of noise generation can be achieved by mounting the armature plate on the holding element and coupling it by means of an adjustable connecting element with the pressure plate, and by arranging the mounting of the armature plate on the holding element between the mounting of the pressure plate and the adjustable connecting element.

6 Claims, 3 Drawing Sheets

(56) References Cited

U.S. PATENT DOCUMENTS

| | | | | |
|---|---|---|---|---|
| 8,181,924 | B2 * | 5/2012 | Pepe | A47F 7/163<br>248/206.5 |
| 8,240,489 | B2 * | 8/2012 | McCormack | A47H 15/02<br>16/87.4 R |
| 8,307,499 | B2 * | 11/2012 | Ruffo | A47H 13/00<br>16/87.2 |
| 2013/0092329 | A1 * | 4/2013 | Eastland | A47H 1/18<br>160/331 |

* cited by examiner

DEVICE FOR HANGING OF TEXTILES

BACKGROUND

Technical Field

The invention concerns a device for the hanging of textiles, such as, for example, curtains, with a holding element, which can be fastened to a fixed structure, a counterplate securely attached onto the holding element, a pressure plate fastened in a hinged manner onto the holding element, wherein the pressure plate with the counterplate forms a clip for purposes of securing the textiles, and with an electromagnet, which operates together with an armature plate so as to close the clip.

Description of the Related Art

Such devices are, for example, used in theatres in order to hang curtains, wherein the opening of the clip provides the possibility of allowing the curtain to fall.

From DE 299 06 503 U such a device is of known art. Here the pressure plate is designed as a two-armed lever, and the armature plate is adjustably fastened onto the pressure plate. Adaptation to the thickness of the textiles to be held is provided by means of the adjustment mechanism. Because of the kinematics of such a system only a low tolerance to fluctuations in the thickness is possible, i.e., if folds occur, for example, the result can be insufficient functionality.

Moreover, the switching of the electromagnet is always linked with noise generation caused by the impacting together of metal parts, which is particularly undesirable in the theatre.

BRIEF SUMMARY

The object of the present invention is to avoid these disadvantages and to specify a solution that is tolerant to fluctuations in the thickness of the textiles and can be switched in a noiseless manner.

In accordance with the invention provision is made for the armature plate to be mounted on the holding element and to be coupled by means of an adjustable connecting element with the pressure plate, and for the mounting of the armature plate on the holding element to be arranged between the mounting of the pressure plate and the adjustable connecting element.

Surprisingly it has been shown that the above-described tasks can be solved elegantly by the combination of two features that are essential to the invention. Firstly it is important not to position the armature plate on just the pressure plate, but instead directly on the holding element, and secondly the particular arrangement of the pivot axes should ensure that the armature plate in all positions remains in the immediate region of influence of the electromagnet. In the inventive solution a type of four-bar linkage is implemented, in which a small pivoting movement of the armature plate leads to a comparatively large opening of the clip. Here it is of particular advantage if the distance between the mounting of the armature plate and the adjustable connecting element is between 50% and 80% of the distance between the mounting of the pressure plate and the adjustable connecting element. By this means particularly favorable force ratios can be achieved.

In particular it is of particular advantage in this context if in the closed position of the clip a main section of the pressure plate and a main section of the armature plate are arranged essentially parallel to one another. This makes possible a compact and space-saving design.

A particularly favorable form of construction, in which the pressure plate is designed as a one-armed lever, can be achieved by arranging a contact surface of the electromagnet on the armature plate between the mounting of the armature plate and the adjustable connecting element.

Moreover it is particularly favorable in terms of construction if the holding element has a U-shaped cross-section and the electromagnet is accommodated therein.

When considering the circumstances in which the inventive device is designed in particular to hold curtains, it is of advantage if the pressure plate and the counterplate each have an end region angled by approximately 45°. By this means it is possible to accommodate any hem of the curtain in the widening space between pressure plate and counterplate without any difficulty.

A particularly low level of noise generation can be achieved by mounting the adjustable connecting element on elastomers.

BRIEF DESCRIPTION OF THE SEVERAL VIEWS OF THE DRAWINGS

The invention is now explained in more detail with the aid of the variant of embodiment represented in the figures. Here in schematic form.

DETAILED DESCRIPTION

Figure 1:
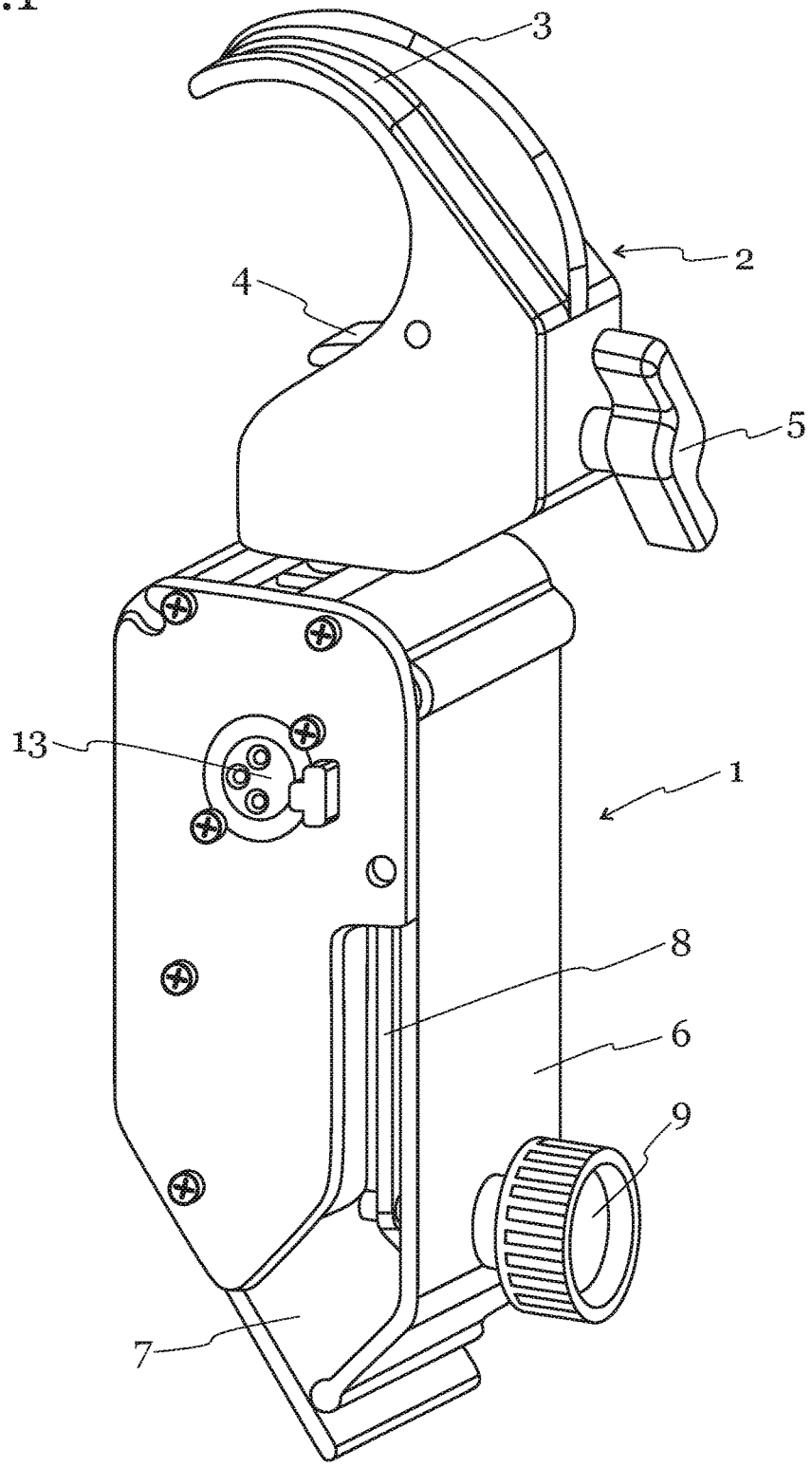
FIG. 1 shows the basic structure of a variant of embodiment of the invention in an oblique view.

The inventive device consists of a holding element 1, which at the same time forms a housing, on which is attached a clamp 2, in order to fasten the device onto a fixed structure, for example a rod. The clamp 2 possesses a curved arm 3, which operates together with an adjustable tongue 4, which can be actuated by means of a finger screw 5, in order to attach the device onto a rod, not represented.

A pressure plate 6, which can be pivoted about an axis 6*a*, is mounted on the holding element 1. The pressure plate 6 possesses an angled end region 6*b* on the end located opposite to the axis 6*a*. The pressure plate 6 operates together with a counterplate 7 so as to form a clip, which serves to secure a curtain, or the like. For this purpose the counterplate 7 similarly possesses an angled end region 7*b*. As a result of the angling through approximately 45° it is achieved that the two end regions 6*b*, 7*b* subtend an angle of approximately 90°, which is ideal for the fastening of the curtain.

The actuation of the pressure plate 6 takes place by means of an armature plate 8, which is mounted such that it can pivot about an axis 8*a*, and which is connected with the pressure plate 6 via an adjustable connecting element 9 in the form of a finger screw. Elastomer elements serve to dampen the noise generated between pressure plate 6, armature plate 8 and connecting element 9.

The section of the armature plate 8 between the mounting 8*a* and the connecting element 9 is designed as a contact surface 8*c*, which operates together with the electromagnet 10.

By means of an electromagnet 10 the pressure plate 6 can be clamped into the closed position of the clip, in which the armature plate 8 ideally abuts against the electromagnet 10, or is at a minimum distance from the latter. In the activated state the electromagnet 10 secures the curtain, and releases the latter if the activation is terminated. The clip opens as a result of the pull of the curtain 12 and, if required, by the self-weight of the pressure plate 6, if the device is mounted somewhat obliquely to the vertical.

Figure 2:
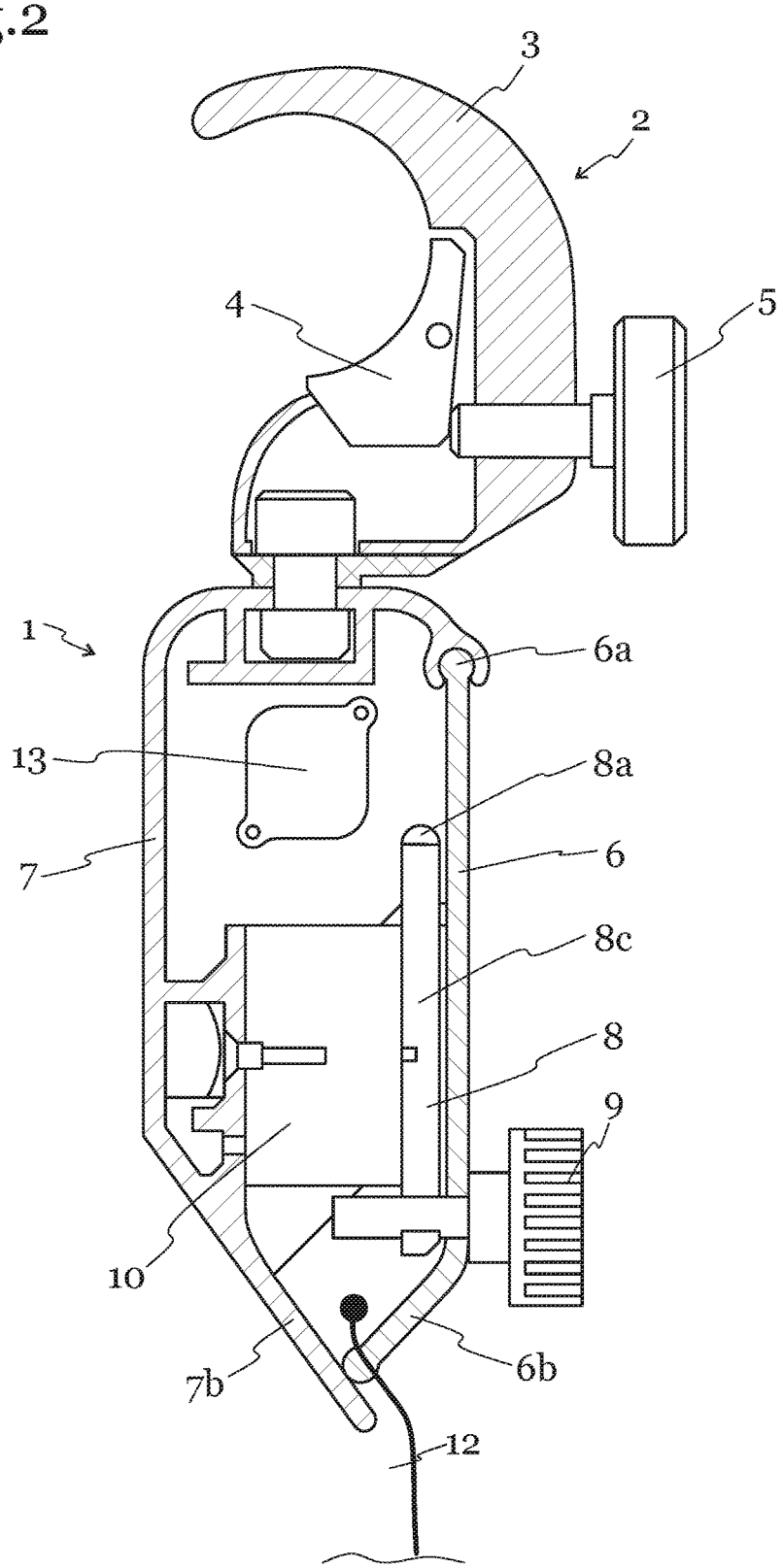
FIG. 2 shows the variant of embodiment in FIG. 1 in a side view in the closed state.

In the representation in FIG. 2 a curtain 12 of very little thickness is represented as an example; this is clamped between the angled end regions 6*b*, 7*b* of the pressure plate 6 and the counterplate 7. Should, however, a curtain 12 with a greater thickness be required to be held, the connecting element 9 is adjusted such that the armature plate 8 assumes essentially the same position as represented, while in contrast the pressure plate 6 is appropriately pivoted out towards the right (in FIG. 2).

Figure 3:
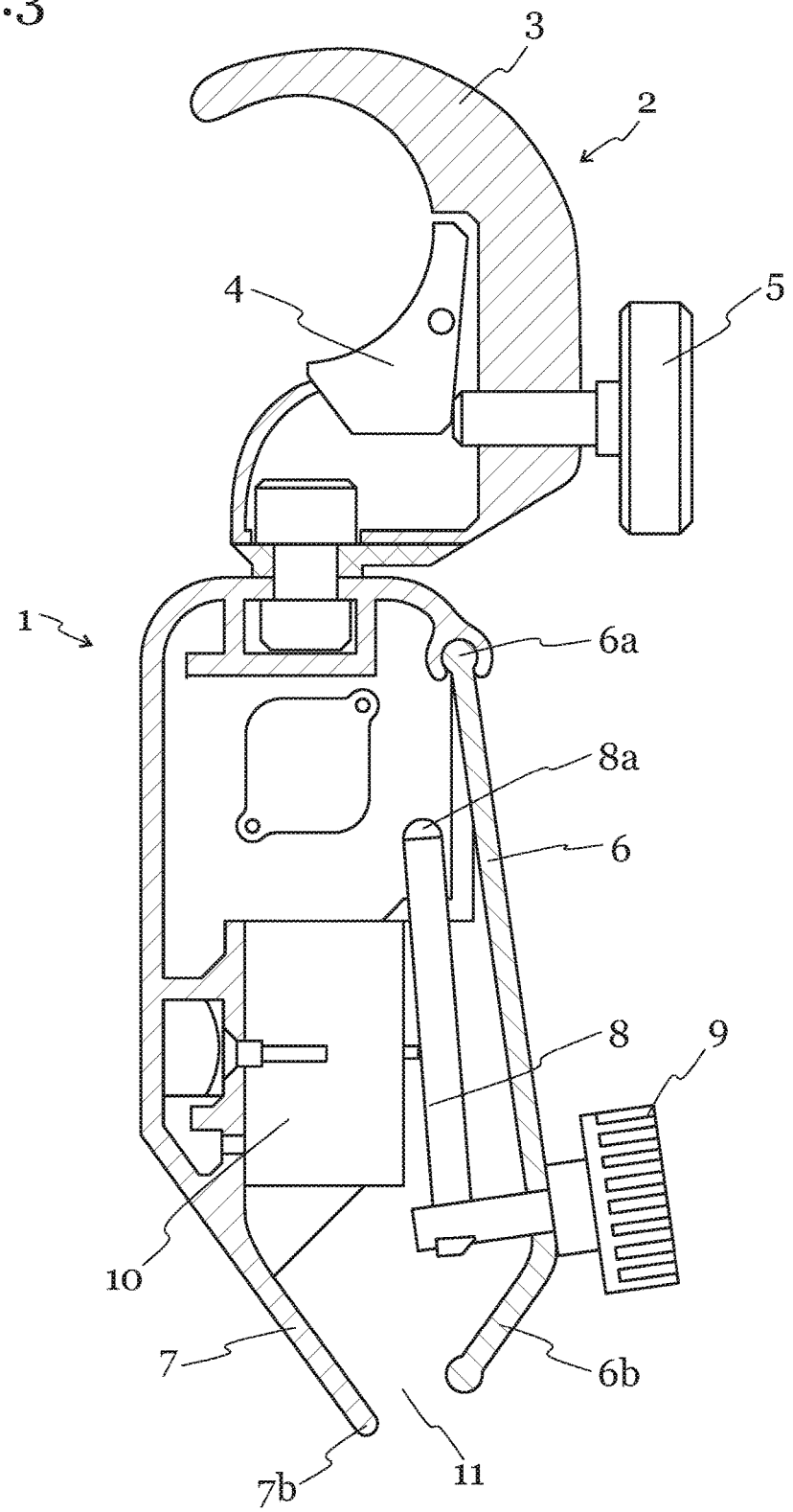
FIG. 3 shows a representation corresponding to that in FIG. 2 in the open state.

In the representation in FIG. 3 the device is shown in an open form, in which a sufficiently large clearance 11 is provided between the angled end regions 6*b*, 7*b* of pressure plate 6 and counterplate 7 to allow the curtain 12 to fall.

The electromagnet 10 is electrically supplied via a terminal connection 13, wherein a bus system is preferably used so as to decouple the power supply and release mechanism from one another. In this manner it is possible simply to activate a plurality of inventive devices in a serial manner, wherein it is nevertheless possible, however, to control each individual device separately.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device for the hanging of textiles comprising:

a holding element, which is configured to be fastened onto a fixed structure, a counterplate securely attached onto the holding element, a pressure plate fastened in a hinged manner about a first axis onto the holding element, wherein the pressure plate with the counterplate forms a clip for purposes of securing the textiles, and with an electromagnet, which operates together with an armature plate to rotate the clip into a closed position, wherein, the armature plate is pivotally mounted on the holding element about a second axis and is coupled by means of an adjustable connecting element with the pressure plate, and the second axis of the armature plate on the holding element is arranged between the first axis of the pressure plate and the adjustable connecting element.

2. The device in accordance with claim 1, wherein, in the closed position of the clip a main section of the pressure plate and a main section of the armature plate are arranged essentially parallel to one another.

3. The device in accordance with claim 1, wherein a contact surface for the electromagnet on the armature plate is arranged between the second axis of the armature plate and the adjustable connecting element.

4. The device in accordance with claim 1, wherein, the holding element has a U-shaped cross-section and the electromagnet is accommodated therein.

5. The device in accordance with claim 1, wherein, the pressure plate and the counterplate each have an end region angled by approximately 45°.

6. The device in accordance with claim 1, wherein the distance between the second axis of the armature plate and the adjustable connecting element is between 50% and 80% of the distance between the first axis of the pressure plate and the adjustable connecting element.

* * * * *